US005273198A

United States Patent [19]

Popovich et al.

[11] Patent Number: 5,273,198

[45] Date of Patent: Dec. 28, 1993

[54] POWDER-ACTUATED, FASTENER-DRIVING TOOL

[75] Inventors: Michael S. Popovich, Schaumburg; Edward D. Yates, Chicago, both of Ill.

[73] Assignee: Illinois Tool Works Inc., Glenview, Ill.

[21] Appl. No.: 947,433

[22] Filed: Sep. 21, 1992

[51] Int. Cl.[5] ..... B25C 1/14

[52] U.S. Cl. ..... 227/10

[58] Field of Search ..... 227/8, 9, 10, 11

[56] References Cited

U.S. PATENT DOCUMENTS

| | | | |
|---|---|---|---|
| 2,679,645 | 6/1954 | Erickson et al. | 1/44.5 |
| 3,531,037 | 9/1970 | Schneider | 227/10 |
| 3,552,625 | 1/1971 | Udert | 227/10 |
| 3,645,091 | 2/1972 | Ivanov et al. | 227/10 |
| 3,804,314 | 4/1974 | Gilbert | 227/10 |
| 3,918,619 | 11/1975 | Termet | 227/10 |
| 4,565,312 | 1/1986 | Berry | 227/8 |
| 4,598,851 | 7/1986 | Kopf | 227/10 |
| 4,945,730 | 8/1990 | Laney | 227/10 |

*Primary Examiner*—Scott Smith

*Attorney, Agent, or Firm*—Schwartz & Weinrieb

[57] ABSTRACT

A powder-actuated tool for driving fasteners, such as drive pins, into concrete, masonry, or steel workpieces comprises a tool body having a sleeve, a barrel extending forwardly from the tool body, a firing pin mounted operatively in the tool body and movable therein between a dormant position and a firing position, and a manually operable trigger for releasably latching the firing pin and for releasing the firing pin when the trigger is actuated with the firing pin in the dormant position. When moved to an actuated position with the firing pin in the dormant position and releasably latched a spring-loading element extending backwardly from the sleeve manually loads a spring compressively, so as to bias the firing pin toward the firing position.

14 Claims, 5 Drawing Sheets

POWDER-ACTUATED, FASTENER-DRIVING TOOL

TECHNICAL FIELD OF THE INVENTION

This invention pertains to an improved, powder-actuated tool of a type used commonly to drive fasteners, such as drive pins, into concrete, masonry, or steel workpieces. In the improved tool, when a firing pin is releasably in a dormant position and is latched, a biasing spring used to drive the firing pin to a firing position is loaded when a spring-loading element is moved to an actuated position.

BACKGROUND OF THE INVENTION

Commonly, a powder-actuated, fastener-driving tool of the type noted above has a muzzle, which is affixed to a barrel and which must be forcibly pressed against a workpiece to enable the tool to operate. It is known to provide such a tool with an additional mechanism that must be also actuated to enable the tool to operate. Two-handed operation thus is encouraged.

Such a tool designed to encourage two-handed operation is disclosed in Berry U.S. Pat. No. 4,565,312. As disclosed therein, a barrel is arranged so as to be pressed inwardly so as to cock a firing mechanism. Moreover, a blocking member is arranged to block the barrel against being pressed inwardly unless the blocking member is manually disabled.

This invention addresses a perceived need for an improved way to encourage two-handed operation of a powder-actuated, fastener-driving tool of the type noted above.

SUMMARY OF THE INVENTION

This invention provides an improved, powder-actuated, fastener-driving tool of the type noted above, in which it is necessary for a spring-loading element to be suitably moved before a firing pin can be spring-driven to a firing position. Thus, as explained below, two-handed operation is mandated.

Broadly, the improved tool comprises a tool body, a firing pin mounted operatively within the tool body and movable between a dormant position and a firing position, and means for releasably latching the firing pin and a means including a manually actuatable trigger for releasing the firing pin when the trigger is actuated. The improved tool also includes a spring for biasing the firing pin toward the firing position when the spring is loaded and for driving the firing pin to the firing position when the firing pin is released with the spring being loaded.

Moreover, the improved tool comprises a spring-loading element, which is manually movable between an actuated position and a deactuated position. According to this invention, the spring-loading element is arranged so that, when it is moved toward the actuated position with the firing pin being in the dormant position and releasably latched such element loads the spring.

An embodiment having particular utility is contemplated, which further comprises a breech block mounted within the tool body so as to be movable forwardly to an advanced position and so as to be movable backwardly to a retracted position, along with a spring for biasing the breech block so as to resist backward movement of the breech block from the advanced position. A barrel is mounted upon the tool body so as to extend forwardly from a front sleeve of the tool body, so as to be movable forwardly to an inoperative position, and so as to be movable backwardly from the inoperative position, through an engaging position, to an operative position.

The barrel is adapted to perform several functions. Thus, the barrel is adapted to be breech-loaded with a powder cartridge when the barrel is moved to the inoperative position, to engage the breech block in the advanced position when the barrel is moved backwardly to the engaging position, and to move the breech block backwardly to the retracted position, against the resistance of the breech block-biasing spring, when the barrel is moved backwardly, past the engaging position, to the operative position A firing pin in the tool body is releasably latchable to the breech block so as to be conjointly movable with the breech block when latched thereto and so as to be independently movable between a firing position and a dormant position when released. Means are provided for releasably latching the firing pin to the breech block with the firing pin being in the dormant position. A manually operable trigger is provided for releasing the firing pin.

A firing pin-biasing spring is provided for biasing the firing pin toward the firing position when the spring is loaded and for driving the firing pin to the firing position when the firing pin is released with the spring being loaded. A spring-loading element, which is manually movable between an actuated position relative to the firing pin and a deactuated position relative thereto, is arranged so that, when such element is moved to the actuated position with the firing pin being in the dormant position and releasably latched, such element loads the firing pin-biasing spring.

Preferably, the tool body includes a back sleeve, from which the spring-loading element extends backwardly in the deactuated position. Thus, the spring-loading element may be movable forwardly to the actuated position. Preferably, moreover, the improved tool further comprises means mounted on the back sleeve and coactive with the spring-loading element for preventing accidental disassociation of the spring-loading element from the tool body. It is preferred to arrange the firing pin-biasing spring to be compressively loaded by the spring-loading element.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several views, and wherein.

DETAILED DESCRIPTION OF PREFERRED EMBODIMENT

Figure 1:
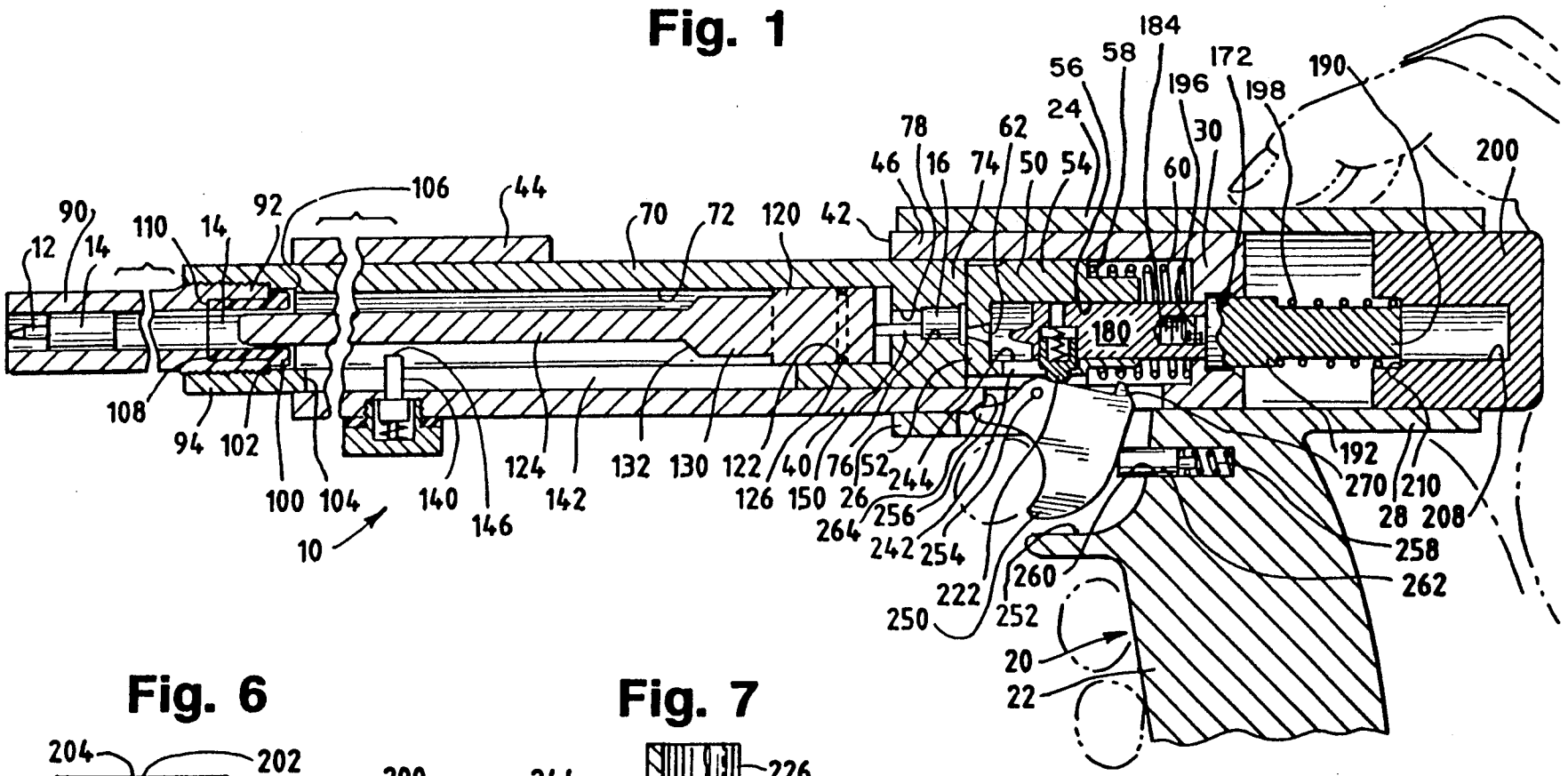
FIG. 1 is a longitudinal, cross-sectional view taken along a vertical plane to show a powder-actuated, fastener-driving tool constituting a preferred embodiment of this invention. Both hands of a user are shown fragmentarily in broken lines. As the tool is shown, it has been loaded with a powder cartridge and with a fastener, which has a guidance flute.

As shown in FIG. 1 and other views, an improved, powder-actuated, fastener-driving tool 10 of the type noted above constitutes a preferred embodiment of this invention. The tool 10 is used to drive fasteners, such as drive pins, into concrete, masonry, or steel workpieces. The tool 10 derives its motive power from cartridges containing gunpowder. A drive pin 12, which is guided by a guidance flute 14, is exemplified in FIG. 1 and a rim-fired, powder cartridge 16 is exemplified in FIG. 1 and other views. Preferably, the drive pin and guidance flute are similar to the drive pin and guidance flute disclosed in Van Allman et al. U.S. Pat. No. 4,979,858, the disclosure of which is incorporated herein by reference. As described below, the tool 10 is designed for two-handed operation by a user.

The tool 10 comprises a tool body 20 having a pistol grip 22 and having a sleeve 24 with a front portion 26 and a back portion 28. A partition 30, which is mounted fixedly in the sleeve 24, separates the front and back portions of the sleeve 24. A sleeve 40 is inserted into the front portion 26 of the sleeve 24, against the partition 30, and is mounted fixedly to the sleeve 24. Because the sleeve 40 is mounted fixedly thereto, it is convenient to regard the sleeve 40 as a part of the tool body 20. The sleeve 40 has a lateral aperture 42 between a front portion 44 of the sleeve 40 and a back portion 46 of the sleeve 40. The lateral aperture 42 is used to load powder cartridges and to unload spent cartridges.

Figure 4:
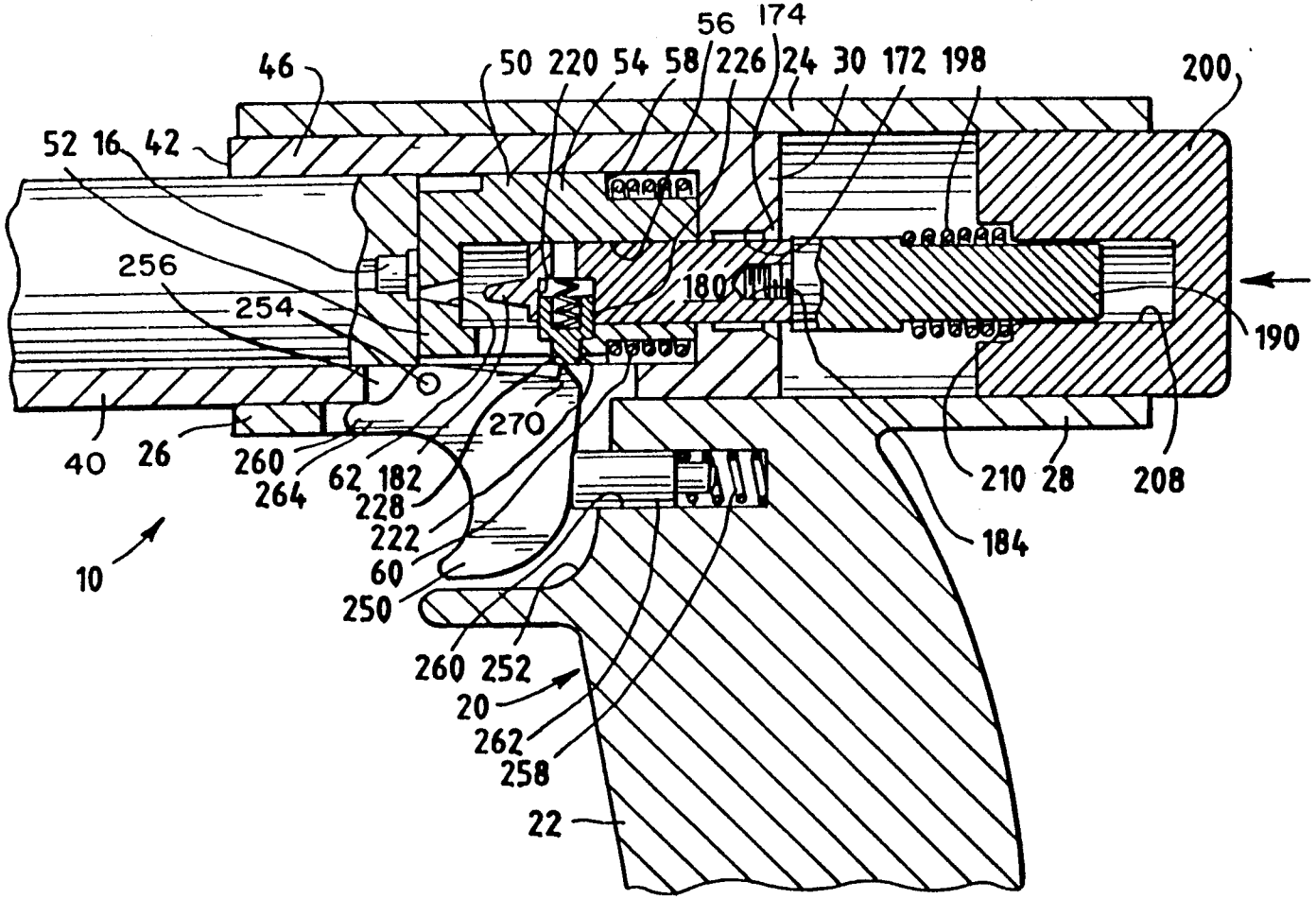
FIG. 4, on the same scale, is a substantially similar, fragmentary view of the tool with a spring-loading element moved to an actuated position relative to the firing pin.
Figure 5:
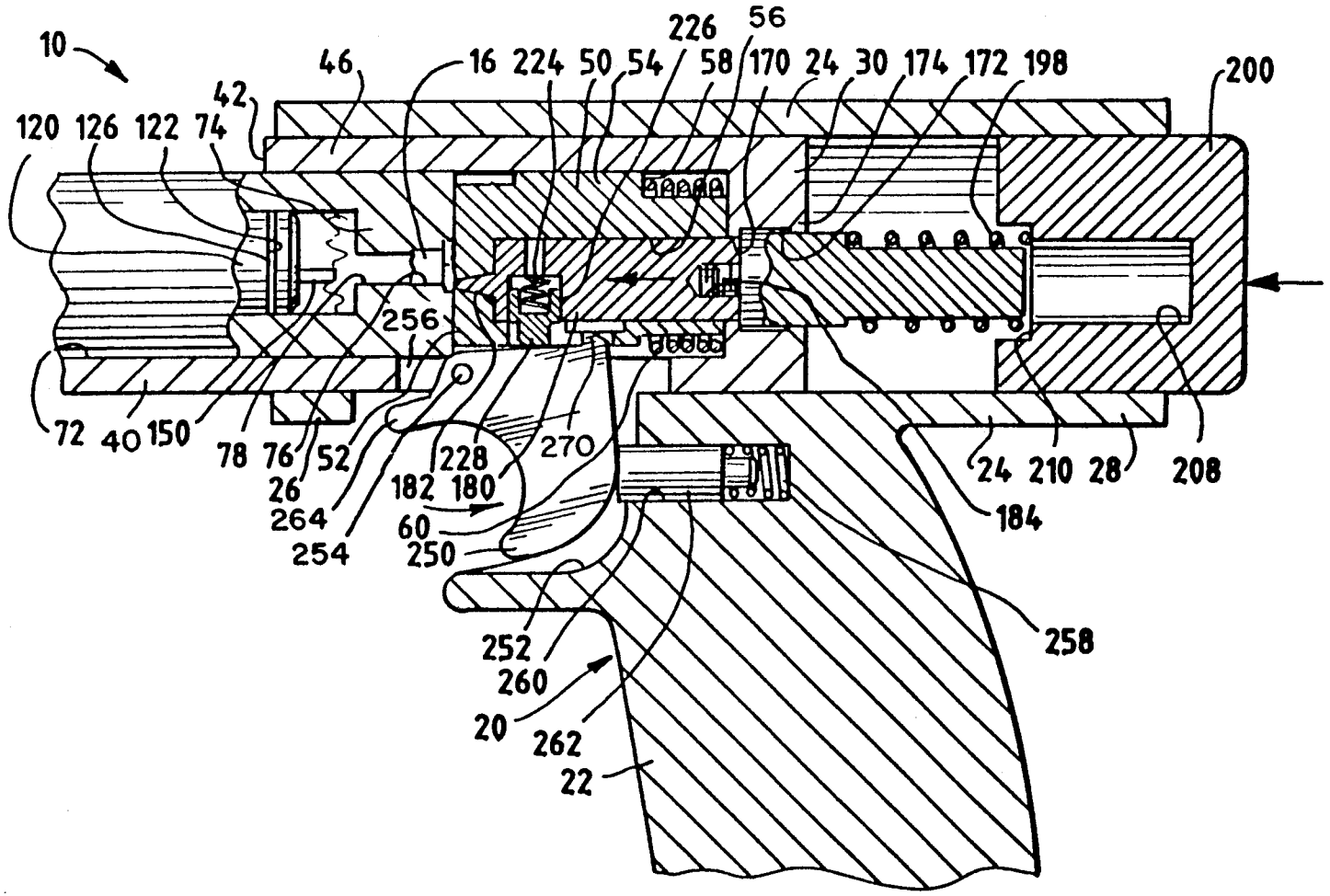
FIG. 5, on the same scale, is a substantially similar, fragmentary view of the tool after the trigger has been actuated.

A breech block 50 including a front disc portion 52 and a back sleeve portion 54 affixed to the disc 52 is mounted in the back portion 46 of the sleeve 40. The breech block 50 is mounted therein so as to be movable forwardly to an advanced position (see FIGS. 1 and 2) relative to the tool body 20 and movable backwardly to a retracted position (see FIGS. 3, 4, and 5) relative to the tool body 20. The sleeve portion 54 defines a backwardly opening, eccentric socket 56 (see FIG. 2) and a backwardly facing, annular shoulder 58. A coiled, compressive, breech block-biasing spring 60 is deployed around part of the sleeve portion 54, between the shoulder 58 and the partition 30. The spring 60 is arranged to bias the breech block 50 so as to resist backward movement of the breech block 50 from the advanced position. The disc 52 has a backwardly tapering, frustoconical, eccentric aperture 62.

As shown in FIG. 1, a barrel 70 having a bore 72 is movably mounted with respect to the sleeve 40. The barrel 70 has a breech 74, which has a socket 76 shaped to receive a powder cartridge 16, and which has a passageway 78 extending through the breech 74 and communicating between the socket 76 and the bore 72. The barrel 70 is mounted with respect to the sleeve 40 so as to be movable forwardly to an inoperative position relative to the tool body 20 and movable backwardly from the inoperative position, through a breech block-engaging position relative thereto, to an operative position relative thereto. The barrel 70 is shown in the inoperative position in FIG. 2, in the breech block-engaging position in FIG. 1, and in the operative position in FIGS. 3 and 4.

Figure 2:
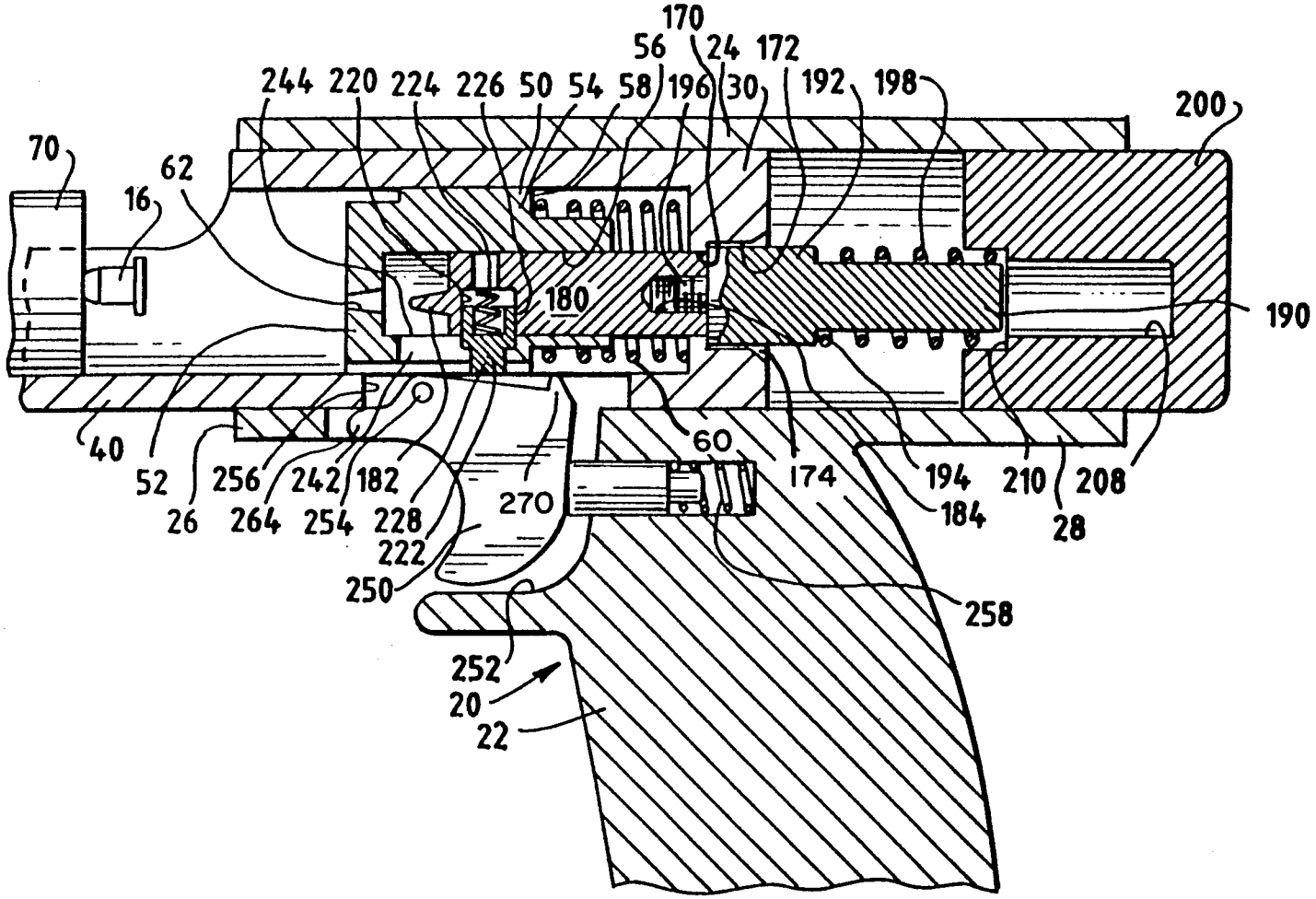
FIG. 2, on a slightly larger scale, is a substantially similar, fragmentary view of the tool with the barrel moved to an inoperative position for loading of the tool with a powder cartridge. Such a cartridge is shown as being loaded into the tool.
Figure 3:
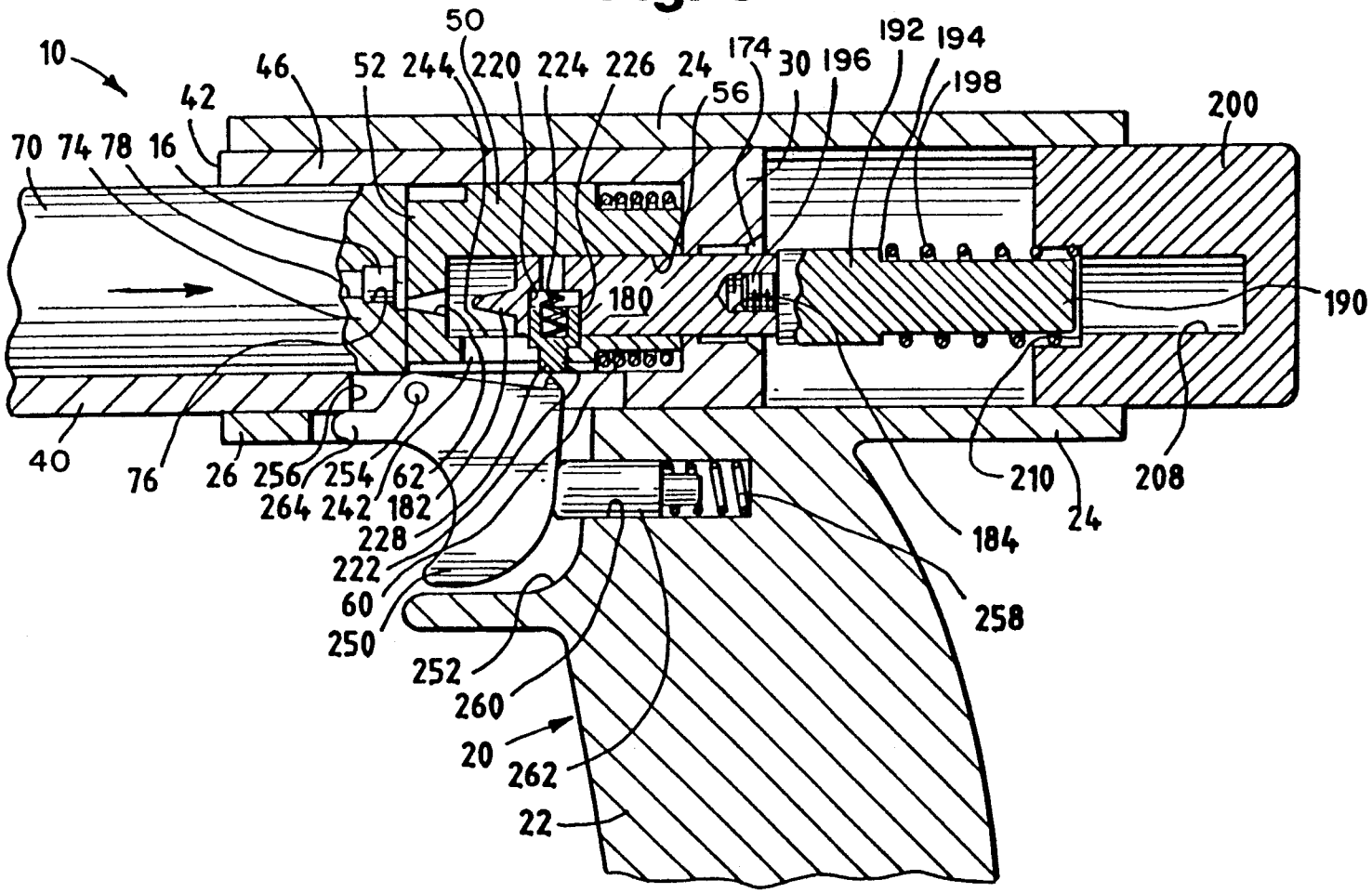
FIG. 3, on the same scale, is a substantially similar, fragmentary view of the tool with the barrel moved to an operative position, with a breech block moved to a retracted position, and with a firing pin moved backwardly with the breech block.

Thus, as shown in FIG. 2, the barrel 70 is adapted to be breech-loaded with a powder cartridge 16 when the barrel 70 is moved forwardly to the inoperative position, by means of the lateral aperture 42 of the sleeve 40. The lateral aperture 42 permits a user to press a powder cartridge 16 forwardly into the socket 76. Also, as shown in FIG. 1, the breech 74 of the barrel 70 is adapted to engage the disc portion 52 of the breech block 50 in the advanced position, when the barrel 70 is moved backwardly to the breech block-engaging position. Further, as shown in FIG. 3, the breech 74 is adapted to move the breech block 50 backwardly to the retracted position, against the resistance of the breech block-biasing spring 60 which thus is compressed, when the barrel 70 is moved backwardly, past the breech block-engaging position, to the operative position. Thus, the breech block 50 is moved backwardly to the retracted position when the barrel 70 is moved backwardly to the operative position against such resistance.

As shown in FIG. 1, a muzzle 90 is threaded into the barrel 70, by means of an external thread on an end portion 92 of the muzzle 90 and an internal thread on an end portion 94 of the barrel 70. The end portion 92 of the muzzle 90 and the end portion 94 of the barrel 70 are shaped so as to seat an annular bumper 100. The bumper 100 is made of a resilient, polymeric material, such as synthetic rubber. A main portion 102 of the bumper 100 is seated against the inner end 104 of the muzzle 90 and within an annular shoulder 106 formed in the barrel 70. A skirt portion 108 of the bumper 100 extends forwardly from the annular portion 102 thereof, into the muzzle 90, and is seated within an annular shoulder 110 formed in the muzzle 90.

When a drive pin 12 and a guidance flute 14 are loaded into the muzzle 90, as shown in FIG. 1, the guidance flute 14 frictionally retains the drive pin 12 in the muzzle 90 so that the drive pin 12 and the guidance flute 14 can be forcibly driven from the muzzle 90. Reference may be made to Van Allman et al. U.S. Pat. No. 4,979,858 for further information concerning such a drive pin and such a guidance flute.

As shown in FIG. 1, piston 120 having an annular groove 122 and a driving blade 124 extending from the piston 120 are made in one piece, which is mounted in the barrel 70, with an O-ring 126 seated in the groove 122, before the bumper 100 and the muzzle 90 are assembled to the barrel 70. The driving blade 124 extends forwardly from the piston 120. The O-ring 126 frictionally retains the piston 120 and the driving blade 124 in the barrel 70 but, permits the piston 120 and the driving blade 124 to be moved forwardly and backwardly in the barrel 70. Near the piston 120, the driving blade 124 has a boss 130 having a shoulder 132. When the piston 120 and the driving blade 124 are driven forwardly for a sufficient distance for the shoulder 132 to strike the main portion 102 of the bumper 100, the bumper 100 arrests forward movement of the piston 120 and the driving blade 124 so as not to impart a strong shock to a person holding the tool 10.

As shown in FIG. 1, a pawl 140 is mounted with respect to the sleeve 40 so as to extend radially into the barrel 70, through an elongate slot 142 in the barrel 70, and so as to be movable inwardly and outwardly over a limited range of radial movement. The pawl 140 limits movement of the barrel 70 relative to the sleeve 40 and with respect to movement between opposite ends of the slot 142. The pawl 140 has an end surface 146, along which the boss 130 of the driving blade 124 slides.

As shown in FIG. 1, the piston 120 has a probe 150 which extends backwardly into the passageway 78 in the breech 74 of the barrel 70 when the piston 120 and the driving blade 124 are moved backwardly to a ready position. In the ready position, the piston 120 is spaced slightly from the breech 74, except for the probe 150. The probe 150, which has an axial length greater than the axial length of the passageway 78, ejects a spent cartridge 16 from the socket 76 when the barrel 70 is moved forwardly for a sufficient distance to cause the pawl 140 to engage the piston 120, to cause the piston 120 to move backwardly, and to cause the probe 150 to extend fully into the passageway 78 so as to engage the spent cartridge 16.

As shown in FIG. 2 and other views, the partition 30 has an eccentric bore 170, which is coaxial with the socket 56 defined by the sleeve portion 54 of the breech block 50, and a socket 172, which is also concentric therewith. The bore 170 and the socket 56 have equal diameters. The socket 172 has a flared edge 174. A firing pin 180 is movably mounted within the bore 170 and the socket 56 and is releasably latchable to the breech block 50 so as to be conjointly movable with the breech block 50 when latched thereto and so as to be independently movable between a firing position relative to the breech block 50 and a dormant position relative thereto. Thus, when released, the firing pin 180 is movable forwardly to the firing position. The firing pin 180 is shown in the firing position in FIG. 5 and in the dormant position in FIGS. 1 through 4.

At its front end, the firing pin 180 has a frusto-conical tip 182, which is adapted to extend through the aperture 62 of the disc portion 52 of the breech block 50, against the rim of a powder cartridge 16 in the socket 76. Thus, the firing pin 180 is adapted to fire a powder cartridge 16 in the socket 76 when the firing pin 180 is driven forwardly to the firing position after the barrel 70 and the breech block 50 have been moved backwardly to the operative position of the barrel 70 and the retracted position of the breech block 50, so as to compress the breech block-biasing spring 60. At its back end, the firing pin 180 has a threaded socket 184.

A biasing pin 190 having a boss 192 defining a shoulder 194 (see FIG. 2) is coaxially attached to the back end of the firing pin 180, by means of a threaded element 196 integral with the biasing pin 190 and threaded into the threaded socket 184 of the firing pin 180, so as to be conjointly movable with the firing pin 180. The boss 192 is adapted to movably fit into the socket, 172 of the partition 30. A firing pin-biasing spring 198 is coiled around the biasing pin 190 so as to bear against the shoulder 194.

Figure 6:
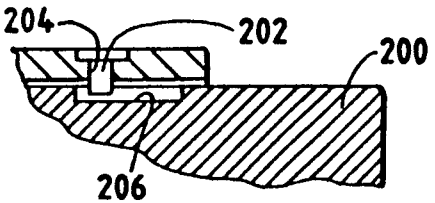
FIG. 6 is a fragmentary, cross-sectional detail taken along a horizontal plane to show means for preventing accidental disassociation of the spring-loading element from the tool body.

A spring-loading button 200 is movably fitted into the back portion 28 of the sleeve 24, behind and in spaced relation to the partition 30. The button 200 is retained by a set screw 202 (see FIG. 6) extending through a threaded hole 204 in the sleeve portion 28, into an elongate groove 206 formed in the button 200, so as to prevent accidental disassociation of the button 200 from the sleeve 24 and so as to permit a limited range of axial movement of the button 200 between a deactuated position relative to the sleeve 24 and an actuated position relative thereto. The button 200 is shown in a deactuated position, at an outer extreme of such range, in FIGS. 3 and 6 and in an actuated position, at an inner extreme thereof, in FIGS. 1, 2, 4, and 5. The button 200 has a forwardly opening socket 208, which is concentric with the bore 170 and the socket 56, and which is stepped so as to define a shoulder 210. The firing pin-biasing spring 198 extends into the socket 208 so as to bear against the shoulder 210.

For the firing pin-biasing spring 198 to be compressively loaded, the firing pin 180 must be releasably latched to the breech block 50, the breech block 50 must be moved backwardly toward the retracted position so as to compress the breech block-biasing spring 60, and the spring-loading button 200 must be axially pressed into the sleeve 24 toward the inner extreme of the limited range of axial movement of the button 200 relative to the sleeve 24.

Figure 7:
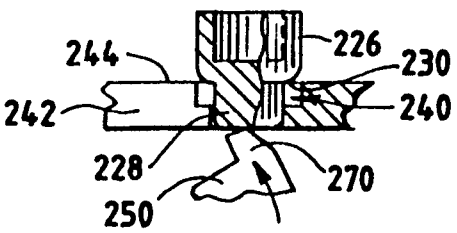
FIG. 7 is a fragmentary, cross-sectional detail of means for releasing the firing pin.

As shown in FIG. 2 and other views, near its front end, the firing pin 180 has a radial socket 220, in which a sear 222 is mounted so as to be movable outwardly to a latching position and so as to be movable inwardly to a releasing position. The sear 222 is shown in the latching position in FIGS. 1 through 4 and in the releasing position in FIG. 5. A coiled spring 224, which is shown diagrammatically as disposed within the socket 220, biases the sear 222 outwardly. The sear 222 has a main portion 226 and an outer portion 228 defining a shoulder 230 (see FIG. 7) where the outer portion 228 adjoins the main portion 226. In the latching position, the sear 222 extends outwardly from the firing pin 180, into a suitably shaped socket 240 in the sleeve portion 54 of the breech block 50 so as to releasably latch the firing pin 180 to the breech block 50. The sleeve portion 54 has an elongate slot 242 having inner edges 244 (one shown) and extending frontwardly from the socket 240.

In the releasing position, the sear 222 releases the firing pin 180 from the breech block 50, so that the outer portion 228 of the sear 222 can be moved forwardly along the slot 242 with the shoulder 230 of sear 222 against and moving slidably along the inner edges 244 (one shown) of the slot 242. Such edges 244 then prevent the sear 222 from moving outwardly. Thus, the firing pin 180 can be driven forwardly within the socket 56 and the bore 170, from the dormant position to the firing position.

A manually actuatable trigger 250 is pivotally mounted to the tool body 20, within a recess 252 in the pistol grip 22, by means of a pivot pin 254 mounted across a slot 256 in the sleeve 40. The trigger 250 is mounted so as to be pivotally movable between a deactuated position and an actuated position. The trigger 250 is shown in the deactuated position in FIGS. 1 through 4 and in the actuated position in FIG. 5. The trigger 250 is biased to the deactuated position by means of a spring 258 disposed within a socket 260 in the pistol grip 22 and engaged with a plunger 262, which extends outwardly from the socket 260 and which engages the trigger 250. The trigger 250 has an integral lip 264. The lip 264 is adapted to engage the sleeve 40, near a front end of the slot 256, so as to limit pivotal movement of the trigger 40 to the deactuated position.

The trigger 250 has an integral tab 270. The tab 270 is adapted to engage the outer portion 228 of the sear 222 and to move the sear 222 inwardly to the releasing position (see FIG. 7) when the trigger 250 is pivoted to the actuated position with the firing pin 180 positioned so that the sear 222 is aligned radially with the tab 270. The tool 10 is arranged so that the sear 222 is aligned radially with the tab 270 when the breech block 50 is moved backwardly to the operative position with the firing pin 180 releasably latched to the breech block 50 by the sear 222.

If the breech block 50 is moved backwardly to the operative position with the firing pin 180 releasably latched to the breech block 50 by the sear 222 and if the trigger 250 is pivoted to the actuated position so as to move the sear 222 inwardly to the releasing position, the firing pin 180 is released from the breech block 50. Thereupon, if the firing pin-biasing spring 198 has been compressively loaded, the firing pin 180 is driven forwardly to the firing position so as to fire a powder cartridge 16 loaded into the socket 76. However if the firing pin-biasing spring 198 has not been compressively loaded the firing pin 180 is not driven forwardly.

When it is desired to unload a spent cartridge 16 from the tool 10 and to load a powder cartridge 16 into the tool 10, the barrel 70 and the muzzle 90 are pulled forwardly to the inoperative position of the barrel 70. Thus, the piston 120 and the driving blade 124 are returned to the ready position. Also the spent cartridge 16 is ejected from the socket 76 of the breech when the probe 150 extends fully into the passageway 78 of the breech 74. Next, a powder cartridge 16 is inserted into the socket 76, by means of the lateral aperture 42 of the sleeve 40.

When it is desired to fire a powder cartridge 16 that has been loaded into the tool 10, the muzzle 90 must be firmly pressed against a workpiece (not shown) so as to move the muzzle 90 and the barrel 70 backwardly to the operative position of the barrel 70. Thus, the breech block 50 is moved backwardly toward the retracted position so as to compress the breech block-biasing spring 60. Also, if the firing pin 180 has not been releasably latched to the breech block 50, it is releasably latched thereto as the breech block 50 is moved backwardly toward the retracted position. Moreover, the spring-loading button 200 must be axially pressed into the sleeve 24 so as to compress the firing pin-biasing spring 198. Alternatively, the muzzle 90 may be pressed against the workpiece before the spring-loading button 200 is pressed into the sleeve, or both may be pressed simultaneously. Thereupon, when the trigger 250 is manually pivoted to the actuated position, the firing pin 180 is released from the breech block 50 and is driven forwardly so as to fire the powder cartridge 16.

Various modifications may be made to the preferred embodiment described above without departing from the scope and spirit of this invention as defined by means of the appended claims.

We claim:

1. A powder-actuated, fastener-driving tool, comprising:

a tool body;

a barrel, within which a fastener to be driven is housed, movably mounted with respect to said tool body between an inoperative, cartridge loading position and an operative, cartridge firing position;

a firing pin operatively mounted within said tool body and movable between a dormant position and a firing position;

means for releasably latching said firing pin within said tool body, and means including a manually actuatable trigger for releasing said firing pin when said trigger is actuated with said firing pin disposed at said dormant position;

means, including a loadable spring, for biasing said firing pin toward said firing position when said loadable spring is loaded and for driving said firing pin to said firing position when said firing pin is released while said loadable spring is loaded; and means including a spring-loading element, which is manually movable, independently of movement of said barrel, between an actuated position relative to said firing pin and a deactuated position relative to said firing pin, for loading said loadable spring when said spring-loading element is moved to said actuated position while said firing pin is releasably latched at said dormant position.

2. The powder-actuated, fastener-driving tool in claim 1, wherein:

said spring-loading element is mounted upon said tool body so as to be movable forwardly toward said actuated position, and movable backwardly toward said deactuated position.

3. The powder-actuated, fastener-driving tool as set forth in claim 1, wherein:

said manually movable spring-loading element comprises a button slidably mounted within a rear portion of said tool body so as to be externally accessible for manual movement from said non-loading deactuated position with respect to said firing pin to said spring-loading actuated position with respect to said firing pin.

4. The powder-actuated, fastener-driving tool as set forth in claim 3, wherein:

said rear potion of said tool body has a rearwardly open recess means defined therein for housing said manually movable button; and means are defined between said button and said rear portion of said tool body for preventing said button from escaping from said recess means of said tool body.

5. The powder-actuated, fastener-driving tool as set forth in claim 3, wherein:

said manually movable button has a forwardly open socket defined therein for receiving a rear potion of said firing pin when said firing pin is disposed at said dormant position and said button is disposed at said actuated position.

6. The powder-actuated, fastener-driving tool as set forth in claim 1, further comprising:

a breech block disposed within said tool body; and said means releasably latching said firing pin within said tool body comprises a spring-biased sear operatively interposed between said firing pin and said breech block and engageable by said manually actuatable trigger such that said trigger can move said sear from a latching position to an unlatching position with respect to said breech block.

7. A powder-actuated, fastener-driving tool, comprising:

a tool body;

a breech block mounted within said tool body so as to be movable forwardly to an advanced position relative to said tool body, and movable backwardly to a retracted position relative to said tool body;

means including a breech block-biasing spring for biasing said breech block so as to resist backward movement of said breech block from said advanced position;

a barrel mounted within said tool body so as to be movable forwardly to an inoperative position relative to said tool body, and movable backwardly from said inoperative position, through a breech block-engaging position relative to said tool body, to an operative position relative to said tool body, said barrel being adapted to be breech-loaded with a powder cartridge when said barrel is moved forwardly to said inoperative position, to engage said breech block, disposed at said advanced position, when said barrel is moved backwardly to said breech block-engaging position, and to move said breech block backwardly toward said retracted position against the resistance of said breech block-biasing spring when said barrel is moved backwardly, past said breech block-engaging position, to said operative position;

a firing pin releasably latchable to said breech block so as to be conjointly movable with said breech block when latched thereto, and so as to be independently movable with respect to said breech block between a dormant position and a firing position when released with respect to said breech block;

means for releasably latching said firing pin to said breech block when said firing pin is disposed at said dormant position, and means including a manually actuatable trigger for releasing said firing pin when said trigger is actuated while said firing pin is disposed at said dormant position;

means, including a firing pin-biasing spring, which is capable of being loaded, for biasing said firing pin toward said firing position when said firing pin-biasing spring is loaded and for driving said firing pin to said firing position when said firing pin is released while said firing pin-biasing spring is loaded; and means including a spring-loading element, which is manually movable, independently of movement of said barrel, between a deactuated position relative to said firing pin and an actuated position relative to said firing pin, and which is normally disposed at said deactuated position, for loading said firing pin-biasing spring when said spring-loading element is moved from said deactuated position toward said actuated position while said firing pin is disposed at said dormant position.

8. The powder-actuated, fastener-driving tool of claim 7, wherein:

said spring-loading element is mounted upon said tool body so as to be movable forwardly to said actuated position, and movable backwardly to said deactuated position.

9. The powder-actuated, fastener-driving tool of claim 7 wherein the tool body includes a sleeve, from which the spring-loading element extends backwardly, the spring-loading element being movable forwardly into the sleeve.

10. The powder-actuated, fastener-driving tool of claim 9 further comprising means mounted on the sleeve and coactive with the spring-loading element for preventing accidental disassociation of the spring-loading element from the sleeve.

11. The powder-actuated, fastener-driving tool of claim 9 wherein the firing pin-biasing spring is arranged to be compressively loaded by the spring-loading element.

12. The powder-actuated, fastener-driving tool as set forth in claim 7, wherein:

said manually movable spring-loading element comprises a button slidably mounted within a rear portion of said tool body so as to be externally accessible for manual movement from said non-loading deactuated position with respect to said firing pin to said spring-loading actuated position with respect to said firing pin.

13. The powder-actuated, fastener-driving tool as set forth in claim 12, wherein:

said manually movable button has a forwardly open socket defined therein for receiving a rear portion of said firing pin when said firing pin is disposed at said dormant position and said button is disposed at said actuated position.

14. The powder-actuated, fastener-driving tool as set forth in claim 7, wherein:

said means releasably latching said firing pin within said breech block comprises a spring-biased sear operatively interposed between said firing pin and said breech block and engageable by said manually actuatable trigger such that said trigger can move said sear from a latching position to an unlatching position with respect to said breech block.

* * * * *